US012760496B2

(12) United States Patent
Boor

(10) Patent No.: US 12,760,496 B2
(45) Date of Patent: Oct. 13, 2026

(54) COUNTERWEIGHT BACKHOE DREDGER

(71) Applicant: IHC Holland IE B.V., Sliedrecht (NL)

(72) Inventor: Marcel Boor, Kinderdijk (NL)

(73) Assignee: IHC Holland IE B.V., Siledrecht (NL)

( * ) Notice: Subject to any disclaimer, the term of this patent is extended or adjusted under 35 U.S.C. 154(b) by 779 days.

(21) Appl. No.: 17/424,500

(22) PCT Filed: Feb. 12, 2020

(86) PCT No.: PCT/NL2020/050076
§ 371 (c)(1),
(2) Date: Jul. 21, 2021

(87) PCT Pub. No.: WO2020/167118
PCT Pub. Date: Aug. 20, 2020

(65) Prior Publication Data

US 2022/0074167 A1 Mar. 10, 2022

(30) Foreign Application Priority Data

Feb. 14, 2019 (NL) ..... 2022575

(51) Int. Cl.
*E02F 5/28* (2006.01)
*E02F 9/18* (2006.01)

(52) U.S. Cl.
CPC . *E02F 5/28* (2013.01); *E02F 9/18* (2013.01)

(58) Field of Classification Search
CPC ..... E02F 5/28; E02F 9/18; E02F 3/32; E02F 9/0866; E02F 9/0808; E02F 5/006; E02F 3/425; E02F 3/427; B63B 35/00
See application file for complete search history.

(56) References Cited

U.S. PATENT DOCUMENTS 3,653,486 A * 4/1972 McLean ..... B65G 65/20 212/196
4,004,696 A * 1/1977 Briggs ..... E02F 9/18 212/196
4,494,906 A * 1/1985 Brocklebank ..... E02F 9/18 212/197
5,533,284 A * 7/1996 Esch ..... E02F 9/0808 37/348

(Continued)

FOREIGN PATENT DOCUMENTS

CN 2355001 Y * 12/1999
CN 203603194 U * 5/2014

(Continued)

*Primary Examiner* — Christopher J Sebesta
*Assistant Examiner* — Blake E Scoville
(74) *Attorney, Agent, or Firm* — Ipsilon USA—NLO

(57) ABSTRACT

The present invention relates to a vessel comprising an excavator for dredging or shifting soil for cleaning watercourses, the excavator comprising;

a weight balanced boom hingeably supported around a boom hinge axis, a bucket-arm hingeably connected to the boom, and provided with a bucket and/or digging tool at a free end of the bucket-arm, wherein a counterweight is connected to the boom and wherein the counterweight is positioned with respect to the boom such that a centre of gravity of the counterweight is above and about vertically aligned with the boom hinge axis when the bucket and/or digging tool is at a lowest digging position.

7 Claims, 2 Drawing Sheets

(56) References Cited

U.S. PATENT DOCUMENTS 7,143,532 B2 * 12/2006 Lowry ..... E02F 9/062
37/309

FOREIGN PATENT DOCUMENTS

| | | | | | |
|---|---|---|---|---|---|
| CN | 106703097 | A | | 5/2017 | |
| CN | 107201759 | A | * | 9/2017 | ..... E02F 3/60 |
| CN | 208455701 | U | | 2/2019 | |
| DE | 2557812 | A1 | | 7/1977 | |
| DE | 3232163 | A1 | * | 3/1984 | |
| DE | 19649826 | A1 | * | 6/1998 | ..... E02F 9/18 |
| EP | 0033060 | A1 | | 8/1981 | |
| EP | 0970915 | A2 | | 1/2000 | |
| JP | 2008208529 | A | | 9/2008 | |
| NL | 2001911 | C2 | | 10/2009 | |
| WO | 2005106138 | A1 | | 11/2005 | |

* cited by examiner

COUNTERWEIGHT BACKHOE DREDGER

FIELD OF THE INVENTION

The present invention relates to a vessel comprising an excavator for dredging or shifting soil for cleaning watercourses, the excavator comprising;

a boom hingeably supported around a boom hinge axis, a bucket-arm hingeably connected to the boom, and provided with a bucket and/or digging tool at a free end of the bucket-arm. The excavator is also referred to as backhoe or backactor. It will be clear that the vessel is a waterborne vessel, that is a dredging vessel, also ship.

BACKGROUND ART

Such a vessel is known from JP 2008-208629 A that relates to a backhoe situated on a pontoon. JP 2008-208629 A seeks to enhance the construction accuracy and construction capability of underwater works.

In dredging operations using a backhoe to excavate, lift and dispose of dredged material in a barge, the power requirements strongly fluctuate during the dredge cycle. In general the dredge cycle consists of:

Horizontally swing the boom from the disposal position above a barge to the water above the excavating position.

Lowering the boom with the empty bucket to the bottom.

Digging with the bucket.

Lifting the full bucket.

Swing the boom to the disposal position above the barge.

Empty the bucket above the barge.

During the lowering of the bucket to the bottom, energy is dissipated. However during lifting the full bucket, the power requirement is highest. For the overall efficiency it would be beneficial to store the dissipated energy during the lowering of the bucket and re-use this during hoisting of the bucket. In this way the energy demand during the cycle will become more evenly distributed and the total cycle will be more efficient regarding energy use. In other words the cycle time may be improved using the same installed power, or the installed power may be reduced for a similar cycle time.

For land-based application the digging with the bucket does not take place (far) below the excavator base so the problem is non-existing in that case. The conventional land based excavators do not have the ability to store energy generated by the lowering of the bucket and re-use this during lifting of the bucket.

SUMMARY OF THE INVENTION

An object of the present invention therefore is to provide a vessel comprising an excavator for dredging that is more efficient regarding use of energy.

Another object is to provide a vessel comprising an excavator for dredging, wherein a problem associated with known excavators is at least partly solved.

Still another object is to provide an alternative vessel comprising an excavator for dredging.

The present invention therefore seeks to provide a vessel comprising an excavator for dredging or shifting soil for cleaning watercourses, the excavator comprising;

a weight balanced boom hingeably supported around a boom hinge axis, a bucket-arm hingeably connected to the boom, and provided with a bucket and/or digging tool at a free end of the bucket-arm, wherein a counterweight is connected to the boom and wherein the counterweight is positioned with respect to the boom such that a centre of gravity of the counterweight is above and about vertically aligned with the boom hinge axis when the bucket and/or digging tool is at a lowest digging position.

The boom being weight balanced by a counterweight connected to the boom and positioned with respect to the boom such that a centre of gravity of the counterweight is above and about vertically aligned with the boom hinge axis when the bucket and/or digging tool is at a lowest digging position is advantageous. The weight balance brings about the benefit that requirements for installed power can be reduced. Normally, lifting the soil requires the most power. The counterweight reduces the power requirement during soil lifting by about 20%. At the same time, because of the position of the counter weight vertically aligned with the boom hinge axis when the bucket and/or digging tool is at a lowest digging position, there is no adverse effect on the cutting force exerted by the digging tool to the rock or soil.

In contrast, conventional backhoes or excavators may have a counterweight, however that counterweight is mounted with the main body and not with the boom. Such a conventional backhoe is sometimes placed on a pontoon. Alternatively, an excavator can be highly integrated with a vessel. Such an highly integrated excavator does not have a counterweight, which is understandable since tipping over of the excavator is not a likely scenario because of the integration of the excavator with the vessel. Also, an additional counterweight would add to the own weight of the vessel which reduces loading capacity of the vessel which is undesirable.

In general, weight balanced boom involves a moveable counterweight which is vertically lifted during the lowering of the bucket to the bottom, and lowered while lifting the bucket. This way, potential energy of the system is balanced. The moveable weight is attached to the so called "boom" of the excavator. The boom is used to lower and lift or raise the bucket by means of hydraulic cylinders. The counterweight is connected to the boom in such a way that at the lowest possible "excavating" position of the bucket at the bottom, virtually no moment is exerted on the boom by the counterweight, which moment would negatively affect the penetration capabilities of the bucket into the soil.

The vessel can be any suitable type of floating structure. The vessel may have spud piles to anchor the vessel. The vessel may have a loading space. The vessel may be a pontoon without an own propulsion system.

In an embodiment of the vessel, the boom extends at both inboard and outboard sides of the boom hinge axis and the counterweight is connected with a boom inboard section. This offers a number of advantages. The boom extending at both inboard and outboard sides of the boom hinge axis offers design freedom to adjust the effect of the counterweight. Also, available inboard space that is normally not used because of the turning circle of the excavator is now utilized to accommodate the counterweight. Further, this enables an improved balance around a vertical rotation axis of the excavator.

Inboard is to say "inside the line of a vessel's bulwarks or hull" or also "toward a center line of a vessel". As a consequence "outboard" means "outside a vessel's bulwarks" or "in a lateral direction from the hull".

In an embodiment of the vessel, the boom is of one-piece. Of one-piece is to say that the boom extends as one piece at both the inboard and outboard sides of the boom hinge axis and is mountable as one piece to the hinge axis. It will clear that the boom may be an assembly of boom sections. The boom of one piece assures a simple construction with less moving parts.

In contrast, conventional excavator booms may be of one piece but do not extend at both sides of a boom hinge axis but instead extend at one side of the hinge only.

In an embodiment of the vessel, the boom has a longitudinal axis, and the boom hinge axis is offset over a spacing s with respect to the boom longitudinal axis. The boom longitudinal axis runs between the two boom ends, in this case from the counterweight to where the bucket-arm hingeably connects to the boom. In this respect, offset is to say that the longitudinal axis and the boom hinge axis do not intersect but instead are spaced by a spacing S. The spacing S offers design freedom with respect to both positioning of the counterweight as well as to the reach of the excavator. In contrast, in a conventional excavator, such a spacing S is absent and instead the boom hinge axis crosses the boom longitudinal axis and the reach is of the excavator would be limited in particular in an area below the body of the excavator.

In an embodiment of the vessel, the excavator comprises a transverse member coupled with the boom, wherein the boom is hingeably coupled with a main frame through the transverse member. The main frame refers to a main structural part that transfers forces from the boom to, usually, a turntable. The transverse member may be a protruding beam profile section that extends transverse with respect to the longitudinal axis of the boom. Other ways to arrange the boom hinge axis offset with respect to the boom longitudinal axis are conceivable like for example a plate constructed boom.

The transverse member assures a lean and simple manner to offset the boom hinge axis with respect to the boom longitudinal axis In an embodiment of the vessel, the counterweight is fixedly connected with the boom. The fixedly connection means that the counterweight moves in unity with the boom at least with respect to translations of the counterweight. It may be conceivable that a counterweight can freely rotate with respect to a weight rotation axis that is fixed with respect to the boom. The counterweight being fixedly connected with the boom assures a simple integration of the counterweight with the boom that requires no additional moving parts or hinge joints.

In contrast, as explained, conventional backhoes or excavators may have a counterweight, however that counterweight is mounted with the main body and not with the boom. It is known to use a counterweight in connection with a boom, however that counterweight is associated with a boom through a linkage system.

In an embodiment, the vessel comprises a hydraulic drive system having a boom cylinder, wherein the boom cylinder is coupled with the boom inboard section to drive the boom. The boom cylinder being coupled with the boom inboard section assures that the weight of the boom cylinder adds to the effect of the counterweight. In addition, this way, the boom cylinder operates out of the so called "splash zone" at the outboard side of the boom. Also, available inboard space that is normally not used because of the turning circle of the excavator is now utilized to accommodate the boom cylinder. In addition, because of the boom cylinder being coupled with the boom inboard section, the boom hinge can be located closer to the water surface which improves the reach of the boom, like the dredging depth with the boom. Over more, the maximum cylinder forces are reduced. Lastly, since there is no direct connection between the outboard boom section and the boom cylinder, the boom can more easily be made dividable and lengthened by means of an articulated boom or by using an intermediate piece or extension piece.

In contrast, conventional excavators always arrange the boom cylinder at the front, that is the side facing the outboard.

In an embodiment of the vessel, the boom cylinder is coupled with the boom proximate a free end of the boom inboard section. The boom cylinder being coupled with the boom proximate a free end of the boom inboard section maximizes the effect of the boom cylinder.

In an embodiment of the vessel, the boom cylinder is hingeably supported above the boom hinge axis. The boom cylinder rotates the boom around the boom hinge axis. Therefore, the boom cylinder is coupled to the boom and the main frame. The boom cylinder being hingeably supported by the main frame above the boom hinge axis enables to optimize the effect of the boom cylinder during operations, in particular during lifting of the soil. Additionally, this configuration allows to have little, if not none, resulting moment on the vessel structure when the bucket is lifted, which is the operation mode wherein the vessel needs more stability.

In contrast, as explained, conventional excavators always arrange the boom cylinder at the front, and support the boom cylinder below the boom hinge axis.

In an embodiment of the vessel, the excavator comprises a turntable for supporting the excavator and to allow the excavator to rotate around a vertical rotating axis, and wherein the centre of gravity of the counterweight is above the turntable when the bucket and/or digging tool is at its lowest digging position. Above is to say that the center of gravity of the counterweight is within the vertical projected area of the turntable, or at least of the bearing thereof.

The counterweight being above the turntable allows an improved support and transfer of forces through the turntable and underlying base structure of the vessel.

In an embodiment of the vessel, the centre of gravity of the counterweight is about vertically aligned with the vertical rotating axis when the bucket and/or digging tool is at its lowest digging position. This allows an even more improved support and transfer of forces through the turntable and underlying base structure of the vessel.

In an embodiment of the vessel, the vessel comprises equipment coupled with the excavator for driving the excavator, wherein the equipment is at least partly, in particular entirely, arranged below a deck level. In this manner, the access to the excavator area is clear, when the excavator is not in operations. At the same time maintenance is improved because of accessibility and due to the fact that the equipment is less exposed to harsh weather conditions.

SHORT DESCRIPTION OF DRAWINGS

The present invention will be discussed in more detail below, with reference to the attached drawings, in which FIG. 1 is a perspective view of a vessel according to the invention;

DESCRIPTION OF EMBODIMENTS

Figure 1:
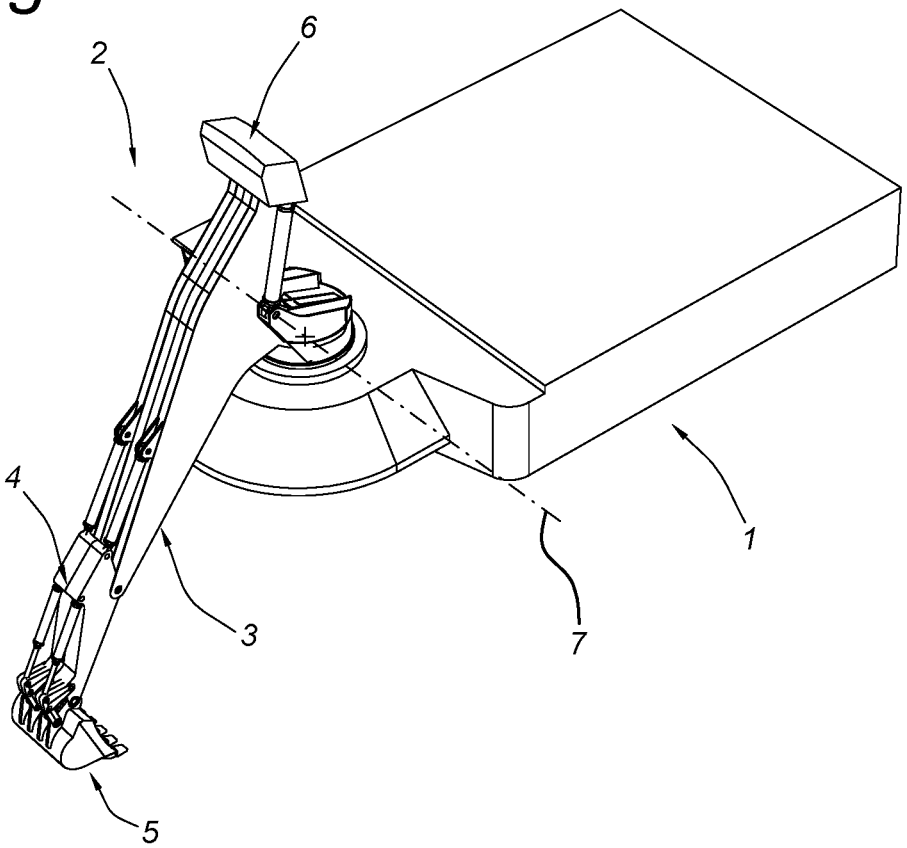
Figure 2:
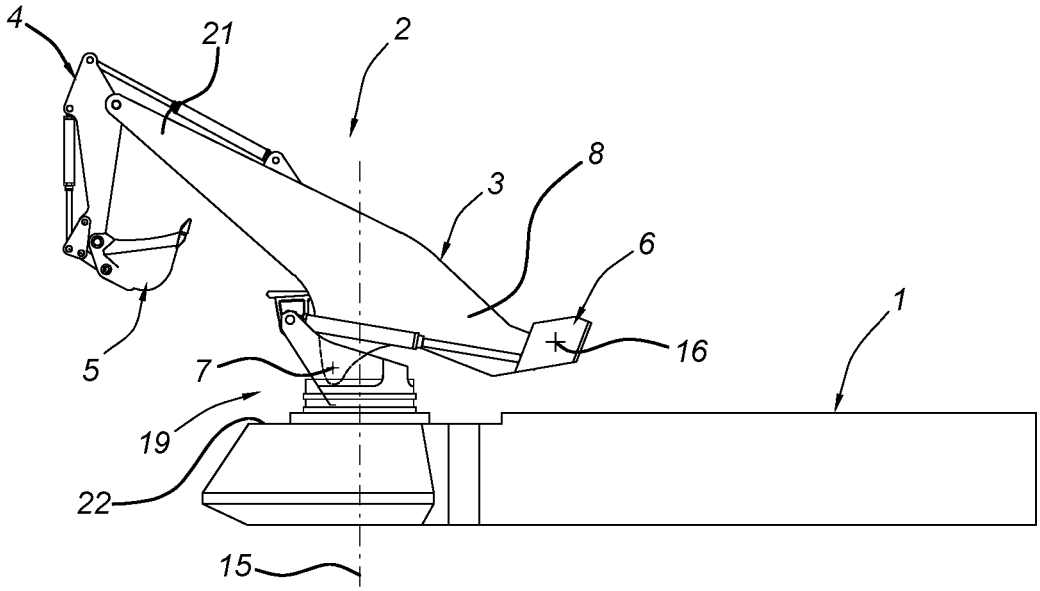
FIGS. 2 and 3 is a side view of the vessel of FIG. 1 in different positions.
Figure 3:
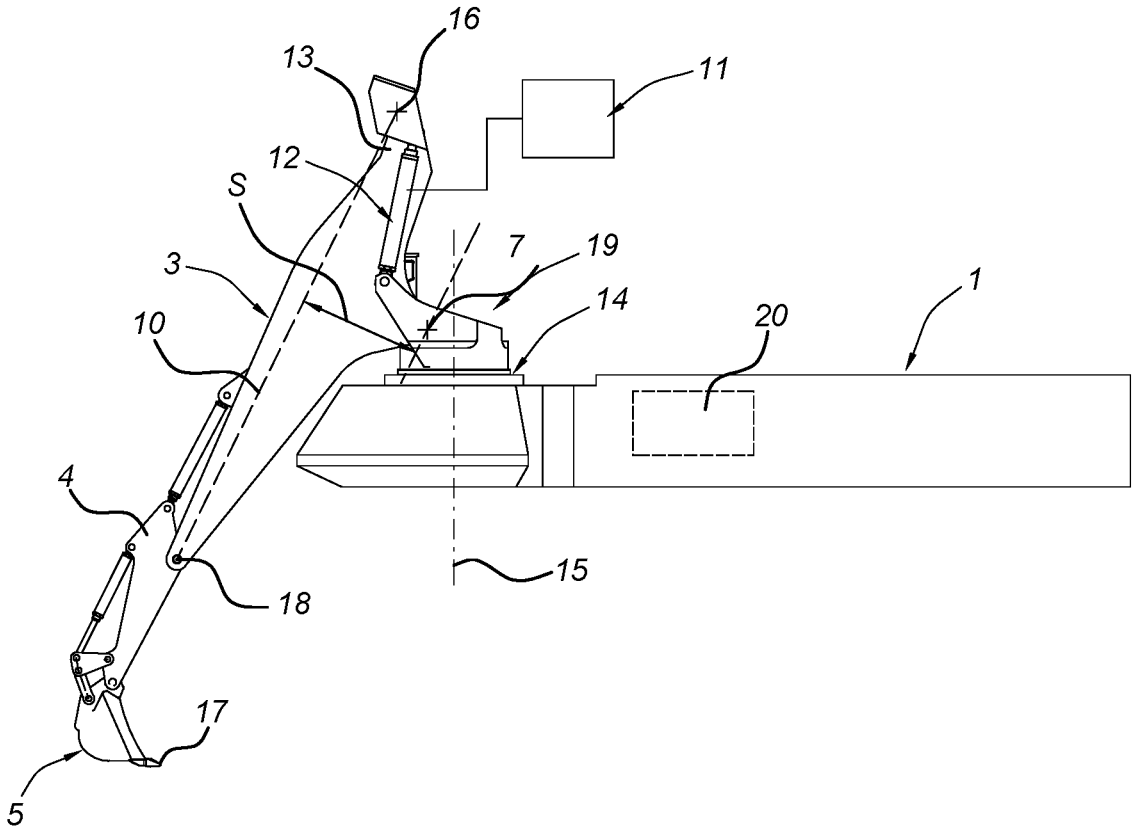

FIG. 1 is a perspective view of a vessel 1 according to the invention. FIGS. 2 and 3 is a side view of the vessel 1 of FIG. 1. FIGS. 1 and 3 shows the vessel 1 in a position wherein a centre of gravity 16 of the counterweight 6 is above and about vertically aligned with the boom hinge axis 7 when the bucket 5 is at a lowest digging position. FIG. 2. shows the vessel 1 in a position wherein the counterweight 6 is lowered and the bucket 5 is lifted and ready to swing to above a loading space (not shown). The vessel 1 according to the invention is described referring to FIG. 1-3.

The vessel 1 comprises an excavator 2. The excavator 2 is suitable for dredging or shifting soil in particular for cleaning watercourses. The excavator is highly integrated with the construction of the vessel 1. This integration allows to mount equipment 20 of the excavator 2 with the vessel as can be best seen in FIG. 3. This way, the equipment is stationary and needs not rotate with the main frame 19 of the excavator 2. The equipment 20 is only schematically shown and may include a main drive system and auxiliary systems. The equipment 20 can be installed within the vessel 1 itself, providing free deck space. Additionally, this will allow to gain vessel stability when performing operations. It will be understood that the equipment 20 can be provided on deck as well as desired.

The excavator 2 comprises a boom 3 for raising and lowering the bucket 5 and bucket-arm 4. The boom 3 is hingeably supported around a boom 3 hinge axis 7. The boom 3 is hingeably coupled to a main frame 19 of the excavator 2. The boom 3 is weight balanced. Therefore, a counterweight 6 is arranged with the boom 3. The counterweight 6 is fixedly connected with the boom 3. The counterweight 6 is positioned with the boom 3 in such a way that a centre of gravity 16 of the counterweight 6 is above and about vertically aligned with the boom 3 hinge axis 7 when the bucket 5 and/or digging tool is at a lowest digging position as best shown in FIG. 1 and FIG. 3.

The excavator 2 comprises a bucket-arm 4 for swinging the bucket 5 with respect to the boom 3. Therefore, the bucket-arm 4 is hingeably connected to the boom 3. The free end of the bucket arm 4 is provided with a bucket 5. The bucket 5 is hingeably connected to the bucket-arm 4. The bucket 5 is provided with digging tools 17 to facilitate digging.

The boom 3 extends at both inboard and outboard sides of the boom hinge axis 7 as best shown in FIG. 2. The boom 3 is of one piece. Here, the boom 3 is made of plate construction work. The bucket-arm 4 is connected with the boom outboard section 21. The counterweight 6 is connected with the boom inboard section 8. The boom 3 has a longitudinal axis 10. The longitudinal axis 10 runs from the counterweight 6 to the hinge joint 18 of the boom 3 and the bucket-arm 4. The boom 3 hinge axis 7 is offset with respect to the boom longitudinal axis 10. The boom 3 hinge axis 7 is offset with respect to the boom longitudinal axis 10 over a spacing S.

The excavator 2 comprises a transverse member coupled with the boom 3. In this case, the transverse member is integrated with the plate construction work that forms the boom 3. Therefore, the boom 3 has a sort of triangular shape in side view. The boom 3 is hingeably coupled with the main frame 19. The boom 3 is hingeably coupled with the main frame 19 at a location near deck position 22 which improves the stability and operational movement of the embodied excavator. This enables less energy consumption per full turning circle of the excavator, when compared with standard excavators. The boom 3 is hingeably coupled with the main frame through the transverse member.

The vessel 1 comprises a hydraulic drive system 11. The hydraulic drive system 11 is not described because it is well known how to drive an excavator having a boom 3, bucket-arm 4 and bucket 5 whit the use of an hydraulic system. The hydraulic drive system 11 has a boom cylinder 12. The boom cylinder 12 is coupled with the boom 3 and the main frame 19 to raise and lower the boom 3 while hinging around the boom hinge axis 7. The boom cylinder 12 is coupled with the boom inboard section 8 to drive the boom 3. The boom cylinder 12 is coupled with the boom 3 proximate a free end 13 of the boom inboard section 8. The boom cylinder 12 is hingeably supported above the boom hinge axis 7 as best shown in FIG. 3.

The excavator comprises a turntable 14. The turntable 14 is configured for supporting the excavator 2 and to allow the excavator 2, or more precisely the main frame 19 of the excavator 2, to rotate with respect to the vessel 1. The turntable 14 allows the main frame 19 to rotate around a vertical rotating axis 15. The centre of gravity 16 of the counterweight 6 is above the turntable 14 when the bucket 5 and/or digging tool is at its lowest digging position as best seen in FIG. 3. In particular, the centre of gravity 16 of the counterweight 6 is about vertically aligned with the vertical rotating axis 15 when the bucket 5 and/or digging tool is at its lowest digging position.

Where the counterweight 6 is shown as a rectangular body, the skilled person will appreciate that the counterweight 6 can be provided with different shapes and/or configurations. The embodied boom 3 is a one piece. A number of attachment configurations are provided such that the connections between the bucket arm 4 and the boom 3 can be easily and rapidly done. The boom 3 is configured such that the connection of the boom 3 to the vessel 1 via the turning table 14 can be handled with an on-board crane (not shown). Where a turning table 14 is shown as the connection of the boom 3 to the vessel 1, any other suitable connection is conceivable, like a flexible base, which is a known connection and is a base that can adapt to different configurations.

The skilled person will appreciate that the vessel 1 might comprise at last two spuds (not shown), preferably three, to provide vessel stability as well as safety when performing excavations.

Figure 4:
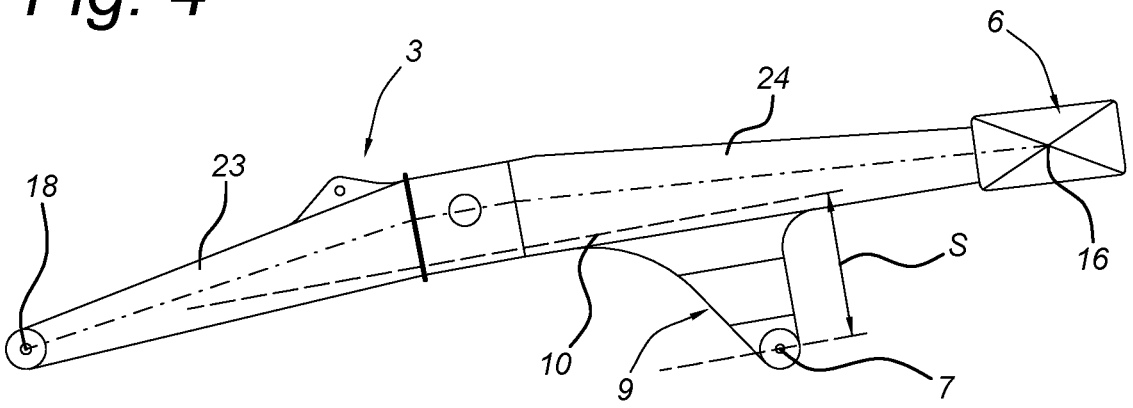
FIG. 4 is another embodiment of a boom.

FIG. 4 shows a side view of another embodiment of the boom 3. Only differences with the boom 3 as shown in FIG. 1-3 are described. The boom 3 is made of beam segments 23, 24. The embodied boom 3 is a one piece comprising beam segments. The transverse beam member 9 is coupled with the longitudinal beam of the boom 3. The beam segments 23, 24 can be extended in length depending on the excavation depth requirements. The transverse beam member 9 is coupled with the longitudinal beam of the boom 3. The transverse beam member 9 comprises the boom hinge axis 7 at its lower portion. As can be clearly seen in this figure, the boom hinge axis 7 is offset over the spacing S with respect to the boom longitudinal axis 10. It should be understood that the height or distance of the spacing S will be determined in relation with the boom length and the mass of the counterweight 6, besides some other parameters e.g. distances between the different points of rotation of the boom 3.

The present invention has been described above with reference to a number of exemplary embodiments as shown in the drawings. Modifications and alternative implementations of some parts or elements are possible, and are included in the scope of protection as defined in the appended claims.

The invention claimed is:

1. A vessel comprising an excavator for dredging or shifting soil for cleaning watercourses, the excavator comprising;

a one-piece weight balanced boom hingeably supported around a boom hinge axis and extending along a boom longitudinal axis from a first end to a second end, wherein the boom hinge axis is positioned between the first end and the second end to form a boom outboard section from the boom hinge axis to the first end and a boom inboard section from the boom hinge axis to the second end, a bucket-arm hingeably connected to the boom at the first end, and provided with a bucket and/or digging tool at a free end of the bucket-arm, wherein a counterweight is directly connected to the boom at the second end in line with the boom longitudinal axis, and wherein the counterweight is positioned with respect to the boom such that a centre of gravity of the counterweight is above and about vertically aligned with the boom hinge axis when the bucket and/or digging tool is at a lowest digging position, the vessel further comprising a hydraulic drive system having a boom cylinder coupled with the boom inboard section to drive the boom, and wherein the boom cylinder is hingeably supported above the boom hinge axis, wherein the boom hinge axis is offset over a spacing with respect to the boom longitudinal axis.

2. The vessel according to claim 1, wherein the excavator comprises a transverse member coupled with the boom, wherein the boom is hingeably coupled with a main frame through the transverse member.

3. The vessel according to claim 1, wherein the counterweight is fixedly connected with the boom.

4. The vessel according to claim 1, wherein the boom cylinder is coupled with the boom proximate a free end of the boom inboard section.

5. The vessel according to claim 1, wherein the excavator comprises a turntable for supporting the excavator and to allow the excavator to rotate around a vertical rotating axis, and wherein the centre of gravity of the counterweight is above the turntable when the bucket and/or digging tool is at its lowest digging position.

6. The vessel according to claim 5, wherein the centre of gravity of the counterweight is about vertically aligned with the vertical rotating axis when the bucket and/or digging tool is at its lowest digging position.

7. The vessel according to claim 1, wherein the vessel comprises equipment coupled with the excavator for driving the excavator, wherein the equipment is at least partly, in particular entirely, arranged below a deck level.

* * * * *